US011060719B2

(12) United States Patent
Andersson et al.

(10) Patent No.: US 11,060,719 B2
(45) Date of Patent: Jul. 13, 2021

(54) CONTROL METHOD FOR THE OPERATION OF A COMBUSTION BOILER

(71) Applicant: Improbed AB, Malmo (SE)

(72) Inventors: Bengt-Ake Andersson, Molnlycke (SE); Fredrik Lind, Torslanda (SE); Henrik Thunman, Partille (SE)

(73) Assignee: Improbed AB, Malmo (SE)

( * ) Notice: Subject to any disclaimer, the term of this patent is extended or adjusted under 35 U.S.C. 154(b) by 200 days.

(21) Appl. No.: 15/735,436

(22) PCT Filed: Jun. 7, 2016

(86) PCT No.: PCT/EP2016/062886
§ 371 (c)(1),
(2) Date: Dec. 11, 2017

(87) PCT Pub. No.: WO2016/202640
PCT Pub. Date: Dec. 22, 2016

(65) Prior Publication Data

US 2018/0180282 A1 Jun. 28, 2018

(30) Foreign Application Priority Data

Jun. 15, 2015 (EP) ..... 15172218
Jun. 25, 2015 (EP) ..... 15173894

(51) Int. Cl.
*F23C 10/28* (2006.01)
*F23N 3/00* (2006.01)
(Continued)

(52) U.S. Cl.
CPC ..... *F23C 10/28* (2013.01); *F23C 10/22* (2013.01); *F23N 1/022* (2013.01); *F23N 3/002* (2013.01);
(Continued)

(58) Field of Classification Search
CPC ..... F23C 10/28; F23C 10/22; F23N 1/022; F23N 3/002
See application file for complete search history.

(56) References Cited

U.S. PATENT DOCUMENTS 3,764,651 A 10/1973 Henkel et al.
3,785,204 A * 1/1974 Lisi ..... G01F 1/86 73/861.03
(Continued)

FOREIGN PATENT DOCUMENTS

CN 102901106 1/2013
CN 103031433 7/2014
(Continued)

OTHER PUBLICATIONS

"Reduce Air Infiltration in Furnaces", EnergyTips-Process Heating (Year: 2006).*
(Continued)

*Primary Examiner* — Jason Lau
(74) *Attorney, Agent, or Firm* — Casimir Jones, S.C.; Brian F. Bradley

(57) ABSTRACT

The invention is in the field of boiler control and relates to a control method for the operation of a combustion boiler, comprising providing a predetermined upper limit (VF,max) for the flue gas velocity in at least one location of the boiler; monitoring the flue gas velocity (VF) during the combustion of fuel in said at least one location of the boiler; comparing the flue gas velocity (VF) with the predetermined upper limit (VF,max); decreasing the thermal load of the boiler if the flue gas velocity exceeds the predetermined upper limit (VF,max). The invention also relates to a control system configured to execute the control method.

12 Claims, 5 Drawing Sheets

Figure 1:
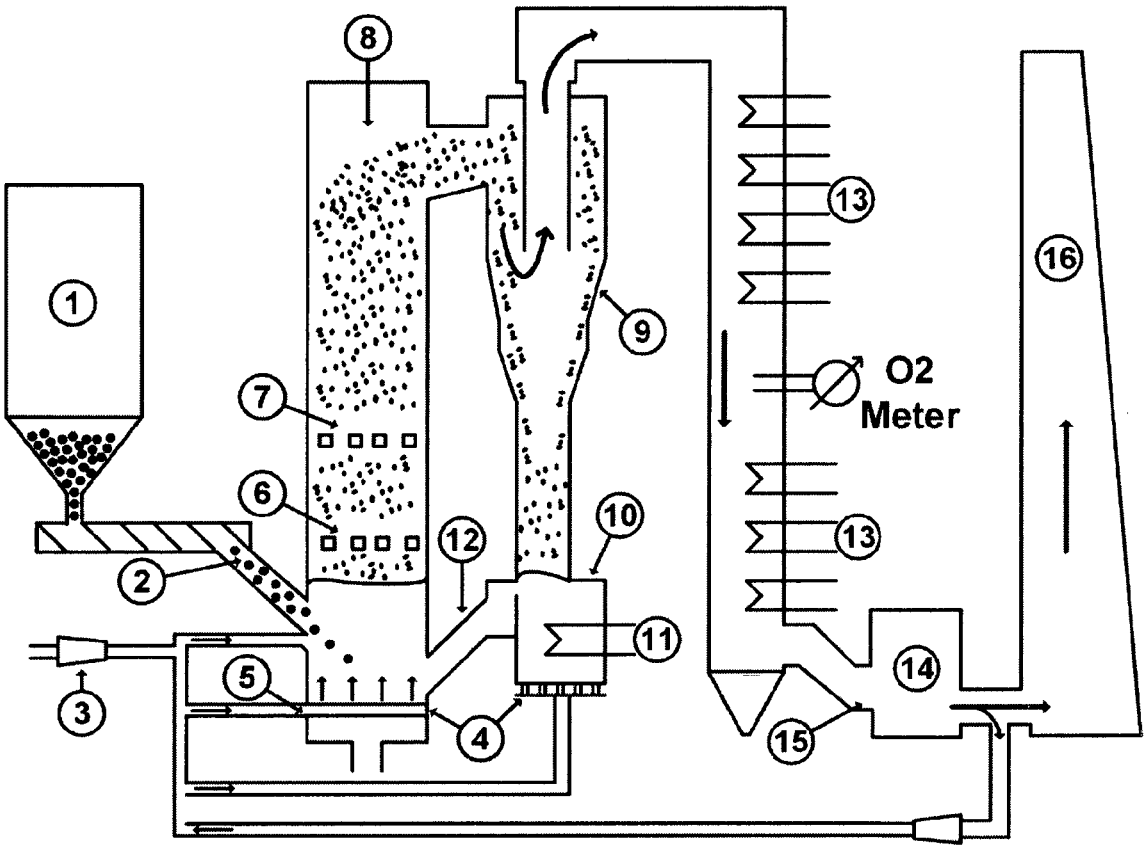

(51) Int. Cl.

| | |
|---|---|
| ***F23N 5/00*** | (2006.01) |
| ***F23C 10/22*** | (2006.01) |
| ***F23N 1/02*** | (2006.01) |

(52) U.S. Cl.

CPC .... *F23N 5/006* (2013.01); *F23C 2900/10001* (2013.01); *F23N 2237/18* (2020.01); *F23N 2900/00* (2013.01)

(56) References Cited

U.S. PATENT DOCUMENTS

| | | | | |
|---|---|---|---|---|
| 3,964,675 | A | 6/1976 | Euchner, Jr. | |
| 4,843,981 | A | 7/1989 | Goldbach et al. | |
| 4,960,057 | A | 10/1990 | Ohshita et al. | |
| 5,127,345 | A * | 7/1992 | Ishikawa | F23G 5/14 110/245 |
| 5,954,000 | A * | 9/1999 | Panos | F23C 10/02 110/165 R |
| 6,808,390 | B1 * | 10/2004 | Fung | C10B 49/10 110/245 |
| 2004/0237909 | A1 | 12/2004 | Krebs | |
| 2010/0037512 | A1 * | 2/2010 | Durand | A01M 1/023 43/139 |
| 2011/0203456 | A1 * | 8/2011 | Hakansson | F01N 3/0871 95/224 |
| 2012/0234008 | A1 * | 9/2012 | Ohki | F02C 1/05 60/682 |
| 2013/0304263 | A1 * | 11/2013 | Liu | F27D 19/00 700/281 |
| 2013/0323654 | A1 | 12/2013 | Ruottu | |
| 2018/0180281 | A1 | 6/2018 | Andersson et al. | |

FOREIGN PATENT DOCUMENTS

| | | |
|---|---|---|
| CN | 204007184 | 12/2014 |
| DE | 4007635 | 9/1991 |
| EP | 0185931 | 7/1986 |
| EP | 1013994 | 6/2000 |
| EP | 2762781 | 8/2014 |
| NZ | 196064 | 1/1986 |
| WO | WO 2016/202639 | 12/2016 |
| WO | WO 2016/202640 | 12/2016 |
| WO | WO 2016/202641 | 12/2016 |

OTHER PUBLICATIONS

Acharya et al. Heavy minerals placer deposits of Ekakula beach, Gahiramatha coast, Orissa, India. Resource Geology 1998; 48(2):125-136.

Corcoran, An analysis of ilmenite particles used as bed material for combustion of biomass in a CFB boiler, Master's Thesis in Sustainable Energy Systems, Chalmers University of Technology, Gothenburg, Sweden, 2013, T2013-397, 51 pages.

Filippou et al., Iron removal and recovery in the titanium dioxide feedstock and pigment industries. JOM 2009; 61(10):36-42.

Thunman et al., Using an oxygen-carrier as bed material for combustion of biomass in a 12-MWth circulating fluidized-bed boiler. Fuel Nov. 2013;113:300-309.

International Search Report and Written Opinion for PCT/EP2016/062885, dated Jan. 18, 2017, 13 pages.

International Search Report and Written Opinion for PCT/EP2016/062886, dated Aug. 17, 2016, 8 pages.

International Search Report and Written Opinion for PCT/EP2016/062887, dated Sep. 13, 2016, 10 pages.

* cited by examiner

CONTROL METHOD FOR THE OPERATION OF A COMBUSTION BOILER

The invention is in the field of combustion boilers, in particular fluidized bed boilers, such as circulating fluidized bed (CFB) boilers, and relates to a control method for the operation of a boiler for the combustion of fuel and to a control system for a boiler for combusting fuel.

Combustion boilers are known in the prior art. These boilers burn fuel, such as for example biomass fuel, waste-based fuel or coal, not excluding others. Typical examples for combustion boilers are grate boilers and fluidized bed boilers. In fluidized bed combustion (FBC), the fuel is suspended in a hot bed of solid particulate material, typically silica sand, which is fluidized by passing a fluidization gas through the bed material. In bubbling fluidized bed BFB boilers, the fluidization gas is passed through the bed material forming bubbles in the bed, facilitating the transport of the gas through the bed material and allowing for a better control of the combustion conditions (better mixing and hence more even temperature distribution in the bed) when compared with grate combustion. In circulating fluidized bed (CFB) boilers, the fluidization gas is passed through the bed material such that the major part of the bed particles become entrained in the fluidization gas so that they are carried away by the fluidization gas stream. The particles are then separated from the gas stream and circulated back into the furnace.

Regardless of boiler type, the combustion conditions, in particular the mixing of oxygen and fuel, are not ideal and for all boilers it is necessary to supply oxygen in excess of the amount required by stoichiometry in order to achieve essentially complete combustion. The chemical composition of the fuel determines the required oxygen flow into the furnace per mass unit fuel and the oxygen to fuel ratios required to burn a given fuel depend strongly on the type and composition of the fuel and in particular on the fuel's heterogeneity. For example, typical fuels are biomass, waste and coal, with the former two being known to be rather inhomogeneous and thus requiring higher amounts of oxygen. In addition, the excess air ratios required are dependent on the type of the boiler used, e.g. pulverized combustion boilers, grates and fluidized bed boilers.

Existing control methods for the operation of combustion boilers generally use the air to fuel ratio as the chief control parameter. The term air to fuel ratio (1) is commonly understood in the art and denotes the amount of air that is fed in relation to the fuel in a combustion unit. It is defined as the ratio determined by the oxygen provided to the furnace for combustion divided by the oxygen needed for stoichiometric combustion and given as $$\lambda = \frac{m_{oxygen,\ provided}}{m_{oxygen,\ stoichiometry}}$$

where $m_{oxygen,provided}$ is the total mass of oxygen that is fed as combustion air to the furnace; and $m_{oxygen,stoichiometry}$ is the mass of oxygen which is needed to reach stoichiometric combustion of the fuel fed to the furnace. The composition of the fuel determines the air flow into the furnace per mass unit fuel and the oxygen concentration in the flue gas is used to balance variations in the fuel composition during the boiler operation. If the composition of the fuel varies during boiler operation, the oxygen concentration in the flue gas, after the combustion zone, varies accordingly. The oxygen concentration can then be used in the control method to adjust the air to fuel ratio with the goal to maintain a constant pre-set oxygen concentration in the flue gas and thereby to arrive at a low emission of organic compounds and high boiler efficiency.

The object of the invention is to provide a method for operating a combustion boiler which facilitates flexible and safe boiler operation.

This object is solved by the features of the independent claims. Advantageous embodiments are defined by the features of the dependent claims.

Feeding excess oxygen into the boiler increases the thermal loss from the boiler due to the increased flow of exhaust gas, thus decreasing the boiler efficiency. Therefore, efforts are made to reduce the need for excess oxygen. For example, from the prior art it is known to use ilmenite as fluidized bed material in the CFB process (H. Thunman et al., Fuel 113 (2013) 300-309). The naturally occurring mineral ilmenite is an iron titanium oxide ($FeTiO_3$) which can be repeatedly oxidized and reduced and thus acts as a redox material. Due to this reducing-oxidizing feature of ilmenite, the material can be utilized as an oxygen carrier in fluidized bed combustion. The ilmenite particles facilitate the mixing of oxygen and fuel and allow to carry out the combustion with less excess oxygen that is at a lower air to fuel ratio.

A lower air to fuel ratio can be either achieved by decreasing the oxygen flow for a given fuel flow or by increasing the fuel load for a given oxygen flow. The latter approach allows to increase the thermal load (thermal output per unit time) of the boiler and thus permits to operate the boiler at higher thermal load and low excess air.

The invention has recognized that a potential problem with this approach is that an increase in the fuel flow leads to an increase in the flue gas velocity. Every boiler design has a maximum flue gas velocity which should not be exceeded in order to avoid problems such as fouling, corrosion, erosion, etc. The invention has further recognized that existing control methods relying chiefly on the air to fuel ratio do not allow to safely increase the thermal load under low excess oxygen conditions, as there is the risk of inadvertently exceeding the design value for the maximum flue gas velocity.

The invention provides a control method for the operation of a combustion boiler, comprising:

a) providing a predetermined upper limit ($V_{F,max}$) for the flue gas velocity in at least one location of the boiler;

b) monitoring the flue gas velocity ($V_F$) during the combustion of fuel in said at least one location of the boiler;

c) comparing the flue gas velocity ($V_F$) with the predetermined upper limit ($V_{F,max}$);

d) decreasing the thermal load of the boiler if the flue gas velocity exceeds the predetermined upper limit ($V_{F,max}$).

The invention has recognized that this method provides an additional handle on the thermal load setting based on the flue gas velocity and thereby facilitates safe and flexible boiler operation. By monitoring the flue gas velocity and decreasing the thermal load in response to the flue gas velocity exceeding a predetermined value, the boiler can be safeguarded against operation above a maximum allowed value for the flue gas velocity. The inventive method allows to safely operate the boiler at or even outside of the design specifications, in particular with increased thermal load under low excess oxygen conditions.

First, several terms are explained in the context of the invention.

The inventive method comprises providing a predetermined upper limit ($V_{F,max}$) for the flue gas velocity in at least one location of the boiler. The term flue gas velocity ($V_F$) denotes the velocity of the flue gas after the combustion zone. The flue gas comprises various components, e.g. the gas generated from the reaction between the fuel and the oxygen supplied to the furnace, any re-circulated flue gas, secondary air supplied and water and air added to the flue gas treatment plant downstream the boiler.

Every boiler design has a design value ($V_{F,design}$) for the flue gas velocity for one or more locations in the boiler. The design value denotes a maximum velocity that should not be exceeded. The design value can for example be learned from the design specifications of the boiler in the boiler documentation.

In preferred embodiments, the predetermined upper limit ($V_{F,max}$) for the flue gas velocity is smaller than or equal to the design value ($V_{F,design}$) for the flue gas velocity in the respective location of the boiler. In particularly preferred embodiments, the predetermined upper limit ($V_{F,max}$) for the flue gas velocity is equal to the design value ($V_{F,design}$) for the flue gas velocity of the boiler. This allows to safely operate the boiler at the specified design limit. In the context of the inventive method, it is also possible for the predetermined upper limit ($V_{F,max}$) for the flue gas velocity to be larger than the design value ($V_{F,design}$) for the flue gas velocity in the respective location of the boiler. Since the design specifications are often given with a safety margin in mind, in this preferred embodiment it becomes possible to operate the boiler outside of the design specifications.

The inventive method further comprises monitoring the flue gas velocity ($V_F$) during the combustion of fuel. The flue gas velocity can be determined according to the following formula:

$$V_F = \dot{V}_C / A;$$

where:

$\dot{V}_C$=the volume flow of flue gas (e.g. in $m^3/s$);

A=the cross-sectional area of the flue gas duct (e.g. in $m^2$).

In the context of the invention, the flue gas velocity can be determined by the skilled person in any location of the flue gas duct after the combustion zone according to the above formula. A preferred location is the duct upstream of the convective heat exchanger tube bundles. Temperature and pressure measurements should be available. The cross-sectional area is different in different parts of the boiler and the flue gas velocity is different in different parts of the boiler. The design value ($V_{F,design}$) for the flue gas velocity is generally given by the boiler supplier in the boiler documentation for various locations of the flue gas duct. Preferably, the flue gas velocity ($V_F$) can be determined for one or more of these locations. It is generally sufficient to determine the flue gas velocity ($V_F$) in one location and compare it to the corresponding predetermined upper limit ($V_{F,max}$), since all flue gas velocities are interrelated.

The volume flow of flue gas $V_C$ can be calculated following the European Standard EN 12952-15. Alternatively, the volume flow of flue gas $V_C$ can be determined from measurement.

For example, in a particular preferred embodiment, the boiler is a circulating fluidized bed (CFB) boiler and the flue gas velocity is determined for the region adjacent and downstream the cyclone, wherein the volume flow of flue gas is determined according to the following formula:

$$\dot{V}_C = \left(\dot{V}_{Total,stack} + \dot{V}_{FGR} - \dot{V}_{Air,FGT} - \dot{V}_{Water\ vapour,FGT}\right) \cdot \frac{T_c}{273} \cdot \frac{1}{P_c}\left(\frac{m^3}{s}\right)$$

where:

$\dot{V}_{Total,stack}$ = total gas flow in the stack $\left(\frac{m_n^3}{s}\right)$ $\dot{V}_{FGR}$ = flow of recirculated flue gas $\left(\frac{m_n^3}{s}\right)$ $\dot{V}_{Air,FGT}$ = air flow added to the flue gas treatment plant $\left(\frac{m_n^3}{s}\right)$ $\dot{V}_{Water\ vapour,FGT}$ = flow of water vapour from the water added to the flue gas treatment plant $\left(\frac{m_n^3}{s}\right)$ $T_c$=temperature just downstream the cyclone (° C.)

$P_c$=pressure just downstream the cyclone (Pa)

wherein the flow of water vapor in the flue gas treatment plant is determined as the mass flow of water (kg/s) added divided by the density of the water vapour ($kg/m^3$).

The total gas flow can be measured by differential pressure using a Prandtl tube located in the flue gas duct at the stack. The flow of recirculated flue gas can be measured by differential pressure using a Prandtl tube located downstream the recirculation gas fan. The air flow to the flue gas cleaning equipment can be measured by means of the fan curve, which describes the characteristics of the fan. The gas temperature Tc can be measured in situ by a thermocouple. The pressure Pc, in the specified location, can be measured by subtracting the pressure drop of the super-heater tube banks from the absolute pressure measured upstream of the economizer.

The inventive method further comprises comparing the flue gas velocity ($V_F$) with the predetermined upper limit ($V_{F,max}$) for the flue gas velocity in the respective location of the boiler and decreasing the thermal load of the boiler if the flue gas velocity exceeds the predetermined upper limit ($V_{F,max}$) for the flue gas velocity.

In the context of the invention, it is for example possible to decrease the thermal load when the flue gas velocity exceeds the predetermined upper limit to maintain the flue gas velocity essentially at the predetermined upper limit. In this case, it is particularly preferred that the predetermined upper limit is equal to the design value for the flue gas velocity. Thus, a closed loop control is achieved that allows to operate the boiler at the design specification maintaining essentially a constant preset flue gas velocity.

Preferably, the thermal load is decreased to reduce the flue gas velocity ($V_F$) below the predetermined upper limit ($V_{F,max}$). In preferred embodiments, the thermal load is decreased until the flue gas velocity ($V_F$) is below the predetermined upper limit ($V_{F,max}$). Advantageously, the thermal load can be decreased continuously or in increments. It is particularly preferred to decrease the thermal load by decreasing the mass flow of the fuel into the furnace of the boiler.

Preferably, the control method also comprises:

e) providing

- a predetermined relationship between the air flow and the fuel flow rate into the furnace of the boiler; and/or
- a predetermined relationship between the air flow into the furnace of the boiler and the thermal load;

f) measuring the fuel flow rate into the boiler and/or the thermal load;

g) adjusting the air flow into the furnace based on the predetermined relationship provided in step e) and the measured fuel flow rate into the boiler and/or the measured thermal load.

The fuel flow rate can preferably be determined by measuring the speed of the fuel feeders. The thermal load produced by the boiler is a standard output, which is routinely measured. It can be calculated by multiplying the measured steam (or feedwater) flow with the enthalpy difference between the feedwater and the steam, both derived from the measured temperature and pressure of the feedwater and steam.

Preferably, the control method further comprises:

h) setting a predetermined lower limit and a predetermined upper limit for the oxygen concentration in the flue gas;

i) monitoring the oxygen concentration in the flue gas during combustion;

j) comparing the oxygen concentration in the flue gas with the predetermined upper limit and the predetermined lower limit for the oxygen concentration in the flue gas; and k) adjusting the air flow into the furnace by increasing the air flow into the furnace if the oxygen concentration in the flue gas is below the lower limit; and decreasing the air flow into the furnace if the oxygen concentration in the flue gas is above the upper limit.

This allows for example to balance variations in the fuel composition during combustion by reacting to the corresponding variations in the oxygen concentration of the flue gas. The oxygen concentration in the flue gas is a commonly measured parameter in commercial boilers. It may typically be measured by an in-situ located lambda probe (zirconia cell) or by using paramagnetic sensors. The skilled person can select suitable upper and lower limits for the oxygen concentration in the flue gas for any given fuel type. Usually suggested ranges are provided by the boiler supplier in the boiler documentation. In a preferred embodiment, the lower limit and the upper limit for the oxygen concentration in the flue gas may be set to the same value. In this case, the oxygen concentration can essentially be kept at a setpoint value.

The inventive method may advantageously provide for an operator to manually adjust the thermal load and/or the air flow into the furnace and/or the fuel flow into the furnace (so called manual handle). This allows to override or adjust the control loops based on expert decision. In a preferred embodiment, manual adjustments may be an increase or a decrease of the thermal load and/or the air flow into the furnace and/or the fuel flow into the furnace by less than 20%, preferably less than 15%, most preferably less than 10%.

Preferably, the boiler can be a fluidized bed boiler, more preferably a bubbling fluidized bed (BFB) boiler or a circulating fluidized bed (CFB) boiler. CFB boilers are particularly preferred in the context of the invention.

Further preferably, the bed material of the fluidized bed boiler comprises ilmenite particles. In a particularly preferred embodiment, the bed material consists of ilmenite particles.

In preferred embodiments, oxygen is supplied to the furnace of the boiler via oxygen containing gas, most preferably air.

The invention also relates to a control system for a combustion boiler, which is configured to execute the control method described above. Preferably, the boiler can be a fluidized bed boiler, more preferably a bubbling fluidized bed (BFB) boiler or a circulating fluidized bed (CFB) boiler. CFB boilers are particularly preferred in the context of the invention. Further preferably, the bed material of the fluidized bed boiler comprises ilmenite particles. In a particularly preferred embodiment, the bed material consists of ilmenite particles.

In the following, advantageous embodiments will be explained by way of example.

It is shown in

Figure 2:
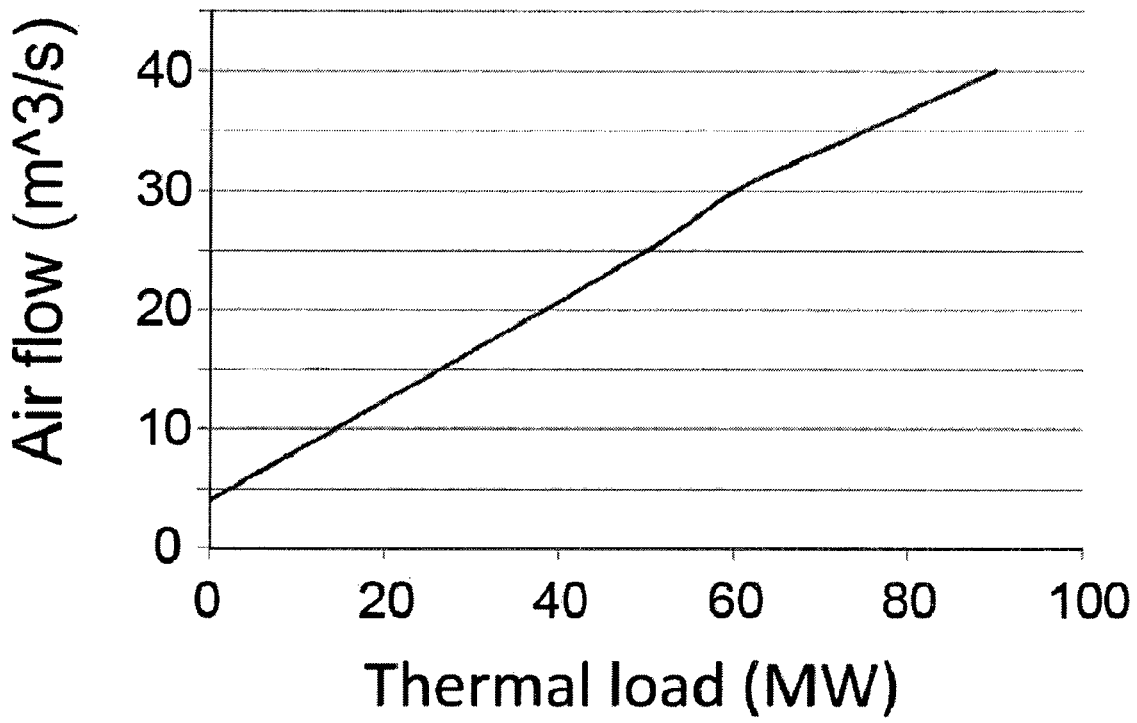
Figure 3:
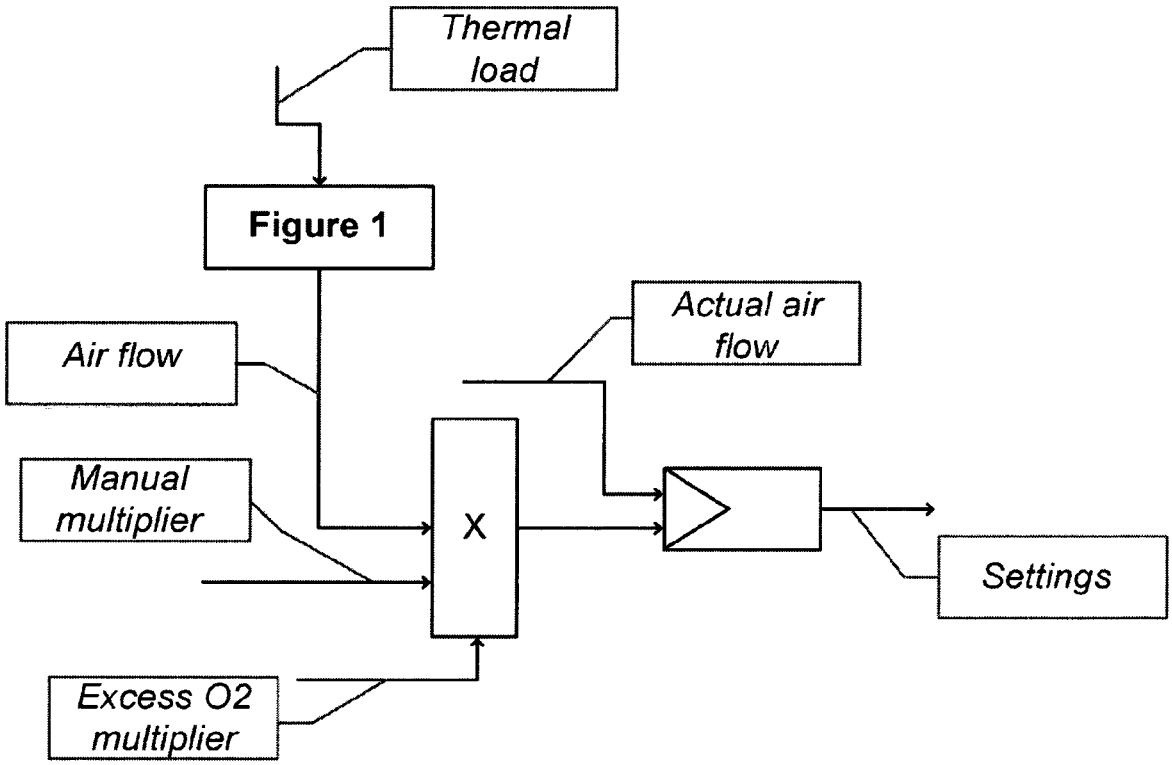
Figure 4:
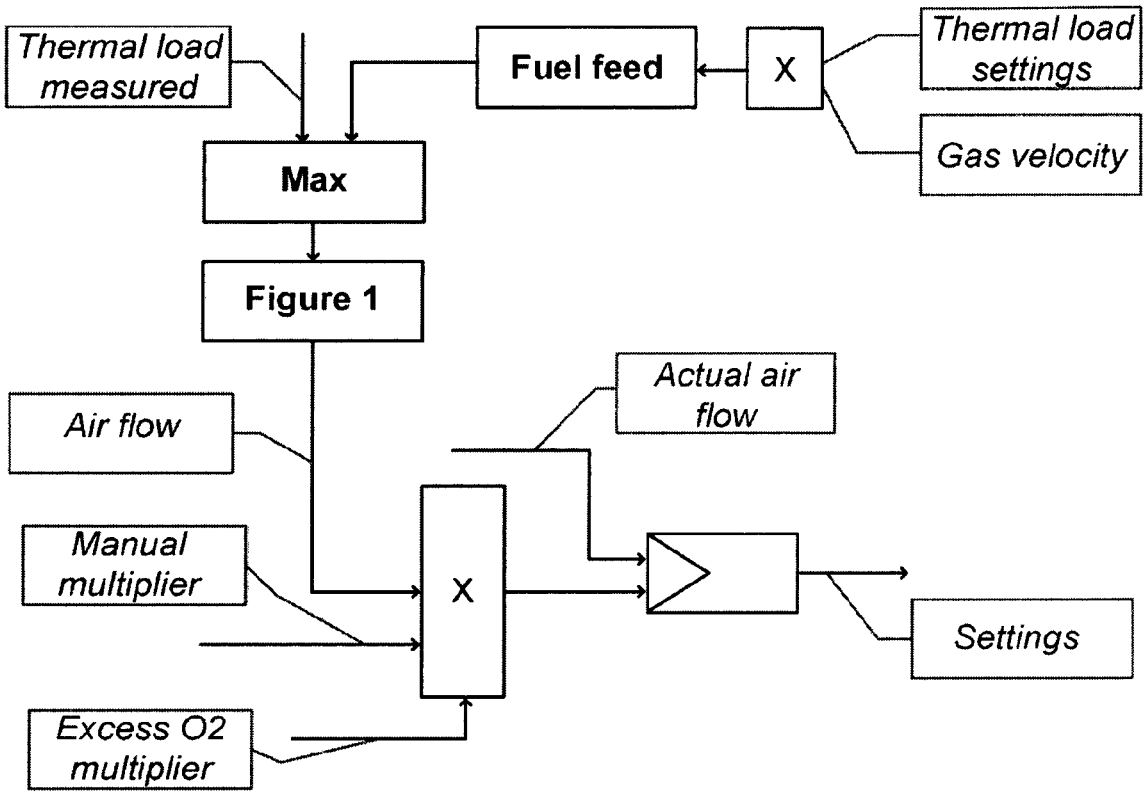
Figure 5:
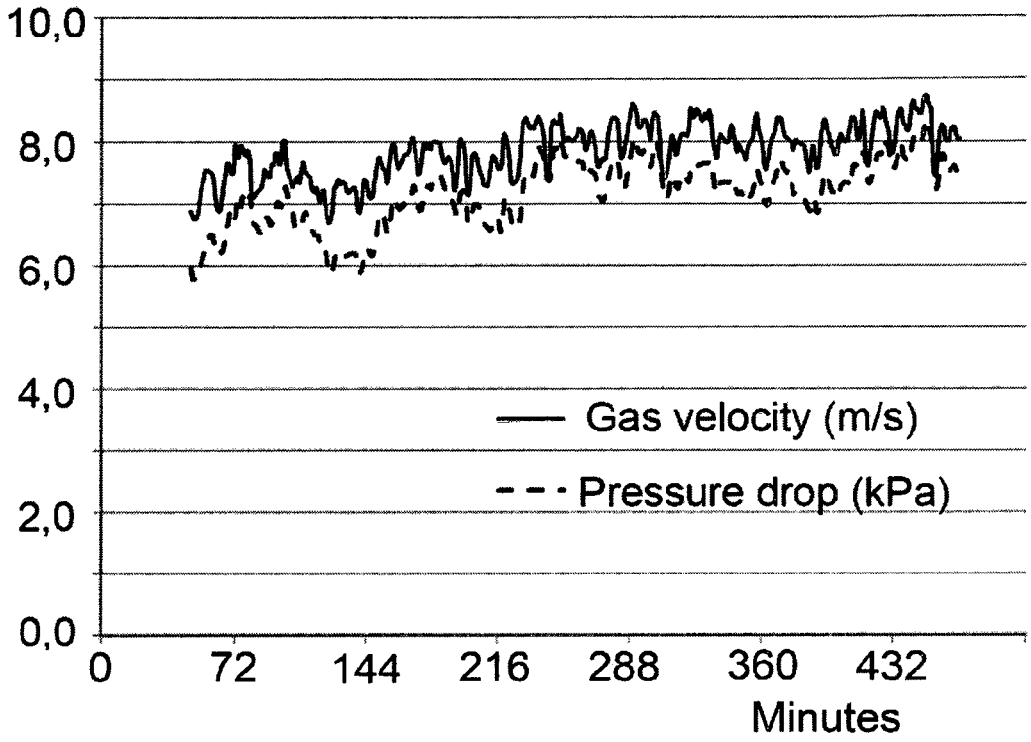

FIG. 1: schematically a CFB boiler;

FIG. 2: schematically a predetermined relationship between air flow into the furnace of the boiler and the thermal load for a given fuel type;

FIG. 3: an example of a prior art control system;

FIG. 4: an example of an inventive control system;

FIG. 5: the measured flue gas velocity in m/s and pressure drop in kPa as a function of time for a CFB boiler.

A CFB BOILER

By way of example, FIG. 1 shows a typical CFB boiler, which can be controlled by the inventive method. The reference numerals denote:

1 Fuel Bunker
2 Fuel Chute
3 Primary Combustion Air Fan
4 Nozzle Bottom
5 Primary Air Distributor
6 Secondary Air Ports
7 Fluidized Bed
8 Furnace
9 Cyclone
10 Loop seal
11 Immersed Superheater
12 Return Leg
13 Heat Exchangers
14 Flue Gas Treatment Plant
15 Flue Gas Recirculation Fan
16 Stack Fuel is stored in the fuel bunker (1) and can be fed to the furnace (8) via a fuel chute (2). The fluidization gas, in this case air, is fed to the furnace (8) as primary combustion air via the primary air distributor (5) from below the bed and passed through the bed material so that the majority of solid particles (bed material, fuel and ash particles) are carried away by the fluidization gas stream. The particles are then separated from the gas stream using a cyclone (9) and circulated back into the furnace (8) via a loop seal (10). Additional combustion air (so called secondary air) is fed into the furnace to enhance the mixing of oxygen and fuel. Secondary air refers to all oxygen containing gas fed into the furnace for the combustion of fuel which is not primary fluidizing gas. To this end, secondary air ports (6) are located throughout the furnace, in particular the freeboard (the part of the furnace above the dense bottom bed).

The flue gas is passed through the flue gas treatment plant (14) for post treatment and the treated flue gas escapes through the stack (16). A portion of the flue gas may be recirculated to the furnace as indicated in FIG. 1.

Comparative Example

A CFB boiler as shown in FIG. 1 is operated with silica sand particles as bed material and controlled by controlling the air to fuel ratio. To this end, a predetermined relationship between the oxygen flow (here air flow) into the furnace of the boiler and the thermal load is provided for the fuel type utilized as shown in FIG. 2. The thermal load produced by the boiler is measured and the air flow into the furnace is adjusted based on the predetermined relationship between the air flow and the thermal load as well as the actual oxygen concentration in the flue gas. To this end, a predetermined lower limit and a predetermined upper limit are set for the oxygen concentration in the flue gas and the oxygen concentration in the flue gas during combustion is monitored. The oxygen concentration in the flue gas is compared with the predetermined upper limit and the predetermined lower limit for the oxygen concentration and the flow of oxygen into the furnace is adjusted by

- increasing the flow of oxygen into the furnace if the oxygen concentration in the flue gas is below the lower limit; and
- decreasing the flow of oxygen into the furnace if the oxygen concentration in the flue gas is above the upper limit.

The lower limit and the upper limit for the oxygen concentration in the flue gas may be set to the same value. In this case, the oxygen concentration can essentially be kept at a setpoint value. The above method provides no handle on the flue gas velocity.

A control system implementing this prior art method is schematically shown in FIG. 3.

Example 1

A CFB boiler as shown in FIG. 1 is operated with ilmenite particles as bed material and controlled by the inventive control method.

This involves providing a predetermined upper limit ($V_{F,max}$) for the flue gas velocity, monitoring the flue gas velocity ($V_F$) during the combustion of fuel, comparing the flue gas velocity ($V_F$) with the predetermined upper limit ($V_{F,max}$) and decreasing the thermal load of the boiler if the flue gas velocity exceeds the predetermined upper limit ($V_{F,max}$).

$V_{F,max}$ is set to the design value ($V_{F,design}$) for the flue gas velocity for the boiler, with $V_{F,design}$ taken from the design specifications.

The flue gas velocity is determined at the region adjacent and downstream the cyclone, according to the following formula:

$$V_F = \dot{V}_C / A;$$

where:

$\dot{V}_C$=the volume flow of flue gas;

A=the cross-sectional area of the flue gas duct;

and wherein the volume flow of flue gas is determined according to the following formula:

$$\dot{V}_C = \left(\dot{V}_{Total,stack} + \dot{V}_{FGR} - \dot{V}_{Air,FGT} - \dot{V}_{Water\ vapour,FGT}\right) \cdot \frac{T_c}{273} \cdot \frac{1}{P_c}\left(\frac{m^3}{s}\right)$$

where:

$\dot{V}_{Total,stack}$ = total gas flow in the stack $\left(\frac{m_n^3}{s}\right)$ $\dot{V}_{FGR}$ = flow of recirculated flue gas $\left(\frac{m_n^3}{s}\right)$ -continued $\dot{V}_{Air,FGT}$ = air flow added to the flue gas treatment plant $\left(\frac{m_n^3}{s}\right)$ $\dot{V}_{Water\ vapour,FGT}$ = flow of water vapour from the water added to the flue gas treatment plant $\left(\frac{m_n^3}{s}\right)$ $T_c$=temperature just downstream the cyclone (° C.)

$P_c$=pressure just downstream the cyclone (Pa)

wherein the flow of water vapor in the flue gas treatment plant is determined as the mass flow of water added divided by the density of the water vapor.

A is taken from the design specifications or obtained by actual measurement of the cross section.

The total gas flow is measured by differential pressure using a Prandtl tube located in the flue gas duct at the stack. The flow of recirculated flue gas is measured by differential pressure using a Prandtl tube located downstream the recirculation gas fan. The air flow to the flue gas cleaning equipment is measured by means of the fan curve, which describes the characteristics of the fan. The gas temperature Tc is measured in situ by a thermocouple. The pressure Pc, in the specified location, is measured by subtracting the pressure drop of the super-heater tube banks from the absolute pressure measured upstream of the economizer.

In this example, the thermal load is decreased either continuously or in increments to reduce the flue gas velocity ($V_F$) below the predetermined upper limit ($V_{F,max}$). The thermal load is decreased by decreasing the mass flow of the fuel into the furnace of the boiler.

In addition, a predetermined relationship between the oxygen flow (here air flow) into the furnace of the boiler and the thermal load is provided for the fuel type utilized as shown in FIG. 2. The thermal load produced by the boiler is measured and the air flow into the furnace is adjusted based on the predetermined relationship between the air flow and the thermal load as well as the actual oxygen concentration in the flue gas. To this end, a predetermined lower limit and a predetermined upper limit are set for the oxygen concentration in the flue gas and the oxygen concentration in the flue gas during combustion is monitored. The oxygen concentration in the flue gas is compared with the predetermined upper limit and the predetermined lower limit for the oxygen concentration and the air flow into the furnace is adjusted by

- increasing the air flow into the furnace if the oxygen concentration in the flue gas is below the lower limit; and
- decreasing the air flow into the furnace if the oxygen concentration in the flue gas is above the upper limit.

The lower limit and the upper limit for the oxygen concentration in the flue gas may be set to the same value. In this case, the oxygen concentration can essentially be kept at a setpoint value.

A control system implementing this inventive method is schematically shown in FIG. 4.

Example 2

The flue gas velocity has been determined in a commercially fired CFB boiler operated with ilmenite particles as bed material.

The flue gas velocity has been calculated from the volume flow of flue gas divided by the cross-sectional area of the flue gas duct in the location just downstream the cyclone, wherein the volume flow of the flue gas was determined according to the formula in Example 1.

The measured flue gas velocity (in m/s) is shown in FIG. 5 together with the measured pressure drop (in kPa) as a function of time for the CFB boiler. The pressure drop is the total pressure drop from the furnace to the suction side of the induced draught fan (the flue gas fan). The flue gas velocity is a very good indicator on the pressure drop during normal operation, as can be seen from FIG. 5, where no lagging between the signals can be seen. If the boiler gets fouled the relationship between the pressure drop and the gas velocity gets affected. FIG. 5 proves that the flue gas velocity is a suitable control parameter.

The invention claimed is:

1. A control method for the operation of a combustion boiler, comprising:

a) providing a predetermined upper limit ($V_{F,max}$) for the flue gas velocity in at least one location of the boiler;

b) monitoring the flue gas velocity ($V_F$) during the combustion of fuel in said at least one location of the boiler, wherein monitoring the flue gas velocity ($V_F$) comprises monitoring a flue gas temperature in the at least one location of the boiler;

c) comparing the flue gas velocity ($V_F$) with the predetermined upper limit ($V_{F,max}$);

d) decreasing the thermal load of the boiler if the flue gas velocity exceeds the predetermined upper limit ($V_{F,max}$), wherein the boiler is a fluidized bed boiler having bed material that comprises ilmenite particles; and wherein at least a portion of the bed material is carried away with a primary gas stream and subsequently separated from the primary gas stream by a cyclone; wherein flue gas velocity ($V_F$) is determined according to the following formula:

$$V_F = \dot{V}_C / A;$$

where:

$\dot{V}_C$=the volume flow of flue gas;

A=the cross-sectional area of the flue gas duct; and wherein the boiler is a circulating fluidized bed (CFB) boiler and the flue gas velocity is determined for the region adjacent and downstream the cyclone and the volume flow of flue gas is determined according to the following formula:

$$\dot{V}_C = \left(\dot{V}_{Total,stack} + \dot{V}_{FGR} - \dot{V}_{Air,FGT} - \dot{V}_{Water\ vapour,FGT}\right) \cdot \frac{T_c}{273} \cdot \frac{1}{P_c} \left(\frac{m^3}{s}\right)$$

where:

$\dot{V}_{Total,stack}$ = total gas flow in the stack $\left(\frac{m_n^3}{s}\right)$ $\dot{V}_{FGR}$ = flow of recirculated flue gas $\left(\frac{m_n^3}{s}\right)$ $\dot{V}_{Air,FGT}$ = air flow added to the flue gas treatment plant $\left(\frac{m_n^3}{s}\right)$ $\dot{V}_{Water\ vapour,FGT}$ = flow of water vapour from the water added to the flue gas treatment plant $\left(\frac{m_n^3}{s}\right)$ $T_c$=temperature just downstream the cyclone (° C.)

$P_c$=pressure just downstream the cyclone (Pa)

wherein the flow of water vapour in the flue gas treatment plant is determined as the mass flow of water added divided by the density of the water vapour.

2. The control method of claim 1, wherein the thermal load is decreased to reduce the flue gas velocity ($V_F$) below the predetermined upper limit ($V_{F,max}$).

3. The control method of claim 1, characterized in that the thermal load is decreased until the flue gas velocity ($V_F$) is below the predetermined upper limit ($V_{F,max}$).

4. The control method of claim 1, wherein the thermal load is decreased by decreasing the mass flow of the fuel into the furnace of the boiler.

5. The control method of claim 1, wherein the predetermined upper limit ($V_{F,max}$) for the flue gas velocity is smaller than or equal to the design value ($V_{F,design}$) for the flue gas velocity for the boiler.

6. The control method of claim 5, wherein the predetermined upper limit ($V_{F,max}$) for the flue gas velocity is equal to the design value ($V_{F,design}$) for the flue gas velocity for the boiler.

7. The control method of claim 1, further comprising:

e) providing a predetermined relationship between the air flow and the fuel flow rate into the furnace of the boiler; and/or a predetermined relationship between the air flow into the furnace of the boiler and the thermal load;

f) measuring the fuel flow rate into the furnace of the boiler and/or the thermal load;

g) adjusting the air flow into the furnace based on the predetermined relationship provided in step e) and the measured fuel flow rate into the boiler and/or the measured thermal load.

8. The control method of claim 1, further comprising:

h) setting a predetermined lower limit and a predetermined upper limit for the oxygen concentration in the flue gas;

i) monitoring the oxygen concentration in the flue gas during combustion;

j) comparing the oxygen concentration in the flue gas with the predetermined upper limit and the predetermined lower limit for the oxygen concentration in the flue gas;

k) adjusting the air flow into the furnace by increasing the air flow into the furnace if the oxygen concentration in the flue gas is below the lower limit; and decreasing the air flow into the furnace if the oxygen concentration in the flue gas is above the upper limit.

9. A control system for a combustion boiler, characterized in that the boiler is a fluidized bed boiler having bed material comprising ilmenite, wherein the control system is configured to execute the control method of claim 1.

10. The control system of claim 9, wherein the fluidized bed boiler is selected from the group consisting of bubbling fluidized bed boilers and circulating fluidized bed boilers.

11. The control method of claim 3, wherein the decrease is a continuous decrease.

12. The control method of claim 3, wherein the decrease is an incremental decrease.

* * * * *